US009373915B1

(12) United States Patent
Schulz et al.

(10) Patent No.: US 9,373,915 B1
(45) Date of Patent: Jun. 21, 2016

(54) GROUND SHIELD FOR CIRCUIT BOARD TERMINATIONS

(71) Applicant: Molex, LLC, Lisle, IL (US)

(72) Inventors: Darian Ross Schulz, Little Rock, AR (US); Mark Alan Bugg, Maumelle, AR (US); Michael Rost, Lisle, IL (US); Munawar Ahmad, Maumelle, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/638,744

(22) Filed: Mar. 4, 2015

(51) Int. Cl.

| | |
|---|---|
| ***H01R 13/658*** | (2011.01) |
| ***H01R 13/6461*** | (2011.01) |
| ***H01R 13/6592*** | (2011.01) |
| ***H01R 13/66*** | (2006.01) |

(52) U.S. Cl.
CPC ..... *H01R 13/6461* (2013.01); *H01R 13/6592* (2013.01); *H01R 13/665* (2013.01)

(58) Field of Classification Search
CPC ..... H01R 2103/00; H01R 13/658; H01R 23/662; H01R 23/688; H01R 13/6658
See application file for complete search history.

(56) References Cited

U.S. PATENT DOCUMENTS

| | | | | |
|---|---|---|---|---|
| 3,770,874 | A | 11/1973 | Krieger et al. | |
| 4,602,832 | A * | 7/1986 | Cunningham | H01R 23/6873 439/108 |
| 4,627,674 | A | 12/1986 | Hamsher, Jr. | |
| 4,871,319 | A | 10/1989 | Babow | |
| 4,993,968 | A | 2/1991 | Guletsky et al. | |
| 5,057,650 | A | 10/1991 | Urushibata | |
| 5,122,065 | A | 6/1992 | Dudek et al. | |
| 5,241,135 | A * | 8/1993 | Fetzer | H01R 9/0512 174/75 C |
| 5,364,292 | A | 11/1994 | Bethurum | |
| 5,679,008 | A | 10/1997 | Takahashi et al. | |
| 5,764,489 | A | 6/1998 | Leigh | |
| 5,810,620 | A | 9/1998 | Kobayashi et al. | |
| 6,139,364 | A | 10/2000 | Beutler et al. | |
| 6,190,196 | B1 | 2/2001 | Kato | |
| 6,232,556 | B1 | 5/2001 | Daugherty | |
| 6,351,884 | B1 | 3/2002 | Damaschke | |
| 6,371,805 | B1 | 4/2002 | Wang et al. | |
| 6,431,887 | B1 | 8/2002 | Yeomans et al. | |
| 6,575,772 | B1 | 6/2003 | Soubh et al. | |
| 6,617,939 | B1 | 9/2003 | Vermeersch | |
| 6,661,318 | B2 | 12/2003 | Tamaki et al. | |
| 6,685,511 | B2 | 2/2004 | Akama et al. | |
| 6,857,898 | B2 | 2/2005 | Engquist et al. | |
| 6,880,241 | B2 | 4/2005 | Edwardsen et al. | |
| 6,893,270 | B2 | 5/2005 | Sercu | |
| 6,927,655 | B2 | 8/2005 | Torigoe et al. | |
| 6,994,563 | B2 | 2/2006 | Amini et al. | |
| 7,046,020 | B2 | 5/2006 | LaMeres et al. | |
| 7,131,862 | B2 | 11/2006 | Vermeersch | |
| 7,223,915 | B2 | 5/2007 | Hackman | |
| 7,244,126 | B2 | 7/2007 | Morana et al. | |
| 7,412,923 | B2 | 8/2008 | Shaeffer et al. | |
| 7,462,071 | B1 * | 12/2008 | Wu | H01R 9/032 439/497 |

(Continued)

*Primary Examiner* — Gary Paumen
(74) *Attorney, Agent, or Firm* — Stephen L. Sheldon

(57) ABSTRACT

A cable-circuit board assembly is disclosed for use in providing a high speed transmission line for connecting electronic devices together. The circuit board is joined to a ground extension member that extends rearwardly of the circuit board and between sets of wires that are terminated to respective surfaces of the circuit board. The extension portion places a ground plane in the termination area of the connector, rear of the trailing edge of the circuit board to provide shielding between pairs of wires on opposite sides of the paddle card where the cable shields are cut back.

20 Claims, 7 Drawing Sheets

(56) References Cited

U.S. PATENT DOCUMENTS

| | | | | |
|---|---|---|---|---|
| 7,498,523 | B2 | 3/2009 | Miller | |
| 7,520,757 | B2 | 4/2009 | Bartholomew | |
| 7,637,779 | B2 | 12/2009 | Nagata et al. | |
| 7,648,372 | B2 | 1/2010 | Wu | |
| 7,887,339 | B2 | 2/2011 | Kumamoto et al. | |
| 8,039,746 | B2 | 10/2011 | Ashida | |
| 8,133,071 | B2 | 3/2012 | Huang | |
| 8,337,243 | B2 | 12/2012 | Elkhatib et al. | |
| 8,614,398 | B2 | 12/2013 | Regnier et al. | |
| 8,662,917 | B2 | 3/2014 | Wang et al. | |
| 8,696,378 | B2 | 4/2014 | Behziz et al. | |
| 8,758,051 | B2 * | 6/2014 | Nonen | H01R 4/023 174/88 R |
| 8,845,364 | B2 | 9/2014 | Wanha | |
| 9,035,183 | B2 * | 5/2015 | Kodama | H05K 1/18 174/74 R |
| 9,049,787 | B2 | 6/2015 | Bugg | |
| 2006/0228935 | A1 * | 10/2006 | Wen | H01R 12/62 439/497 |
| 2006/0228942 | A1 * | 10/2006 | Okano | H01R 12/592 439/579 |
| 2006/0252310 | A1 * | 11/2006 | Yamada | H01R 9/0512 439/579 |
| 2014/0206230 | A1 | 7/2014 | Rost et al. | |

* cited by examiner

GROUND SHIELD FOR CIRCUIT BOARD TERMINATIONS

BACKGROUND OF THE PRESENT DISCLOSURE

The Present Disclosure relates generally to cable interconnection systems, and more particularly, to improved cable terminations in such assemblies for use in high speed data transmission applications.

Conventional cable interconnection systems are found in electronic devices such as routers and servers and the like, and are used to form signal transmission lines. These transmission lines may extend between chip members and connectors, connectors in two different devices, and between devices themselves. Often, differential signal wires are used for each such transmission line in a cable and although it is easy to maintain a desired impedance profile along the length of the cable due to the cable geometry, it is difficult to maintain such a profile at the termination ends of the wires. In some instances, these terminations occur at circuit board that takes the form of an edge, or paddle, card. The wires are terminated to contact pads along the trailing edge of the circuit board. In such a situation, the exterior insulation is stripped back and the bare conductors are terminated to solder pads or the like. The outer shields of the cable wires are also removed for an extent to facilitate the attachment of the cable wire free ends to the circuit card. As such, this termination area is left without a ground plane from the rea of the solder pads to the end of the cable wire outer shields. This ungrounded area has been known to contribute to and increase the crosstalk between the cable wires, especially in high speed applications. It is desirable to therefore have a cable termination with a structure that lessens the crosstalk in the termination area.

The Present Disclosure is therefore directed to a cable assembly that is particularly suitable for high speed data transmission applications.

SUMMARY OF THE PRESENT DISCLOSURE

Accordingly, there is provided an improved high speed cable assembly that has an improved termination structure that is suitable for beneficial termination in high speed data transmission applications.

In accordance with an embodiment as described in the following Present Disclosure, a cable assembly is disclosed that utilizes a circuit board, preferably in the form of a paddle card, to which the wires of the multi-wire cable are terminated. The circuit board includes front contact pads which engage terminals of an opposing mating connector, as well as rear, or termination contact pads to which free ends of the cable wires are terminated. The cable wires have their free ends stripped of insulation, their outer grounding shield peeled back upon themselves and their free ends soldered to the termination contact pads. In order to provide grounding and shielding in the area rearward of the circuit board, a conductive extension member is provided in the form of a metal ground plate. The ground plate is disposed exterior of the circuit board and extends widthwise of the circuit board and has a length sufficient to extend underneath the cable wire insulation which is peeled back upon the cable wire.

The ground plate extends from close to the rear, or trailing, edge of the circuit board and underneath the cable wires, which are arranged in pairs for connection to contact pads or the like disposed on the top and bottom sides of the circuit board. The cable wires have their insulation coverings stripped from the ends thereof. The wires are usually arranged in pairs of wires that are enclosed within outer grounding shields in the form of either a conductive braid or foil wrapping. The wire insulation and outer shield are trimmed back so that the wire conductors are exposed in a fashion for easy termination to the circuit board. When stripped, the cable wire outer shield is usually peeled back over the wire insulation and a bare (non-shielded) extent of the cable wire insulation is exposed that extends between the leading edge of the insulative covering and the leading edge of the exterior shield. As the wire pairs are arranged in rows along the top and bottom surfaces of the circuit board and the wire pair conductors are terminated to contact pads on the top and bottom surfaces of the circuit board, a gap occurs between the top and bottom sets of wire pairs respectively attached to the circuit board. This gap area is prone to increased crosstalk between the top and bottom sets of wire pairs, and it also introduces discontinuities in the impedance profile of the cable assembly.

The ground plate extends axially rearwardly from the circuit board into this gap between the leading edge of the wire shield and the trailing edge of the circuit board. It fills the intervening space of the gap between the top and bottom pairs of cable wires with a ground plane, and this ground plane provides shielding between the top and bottom wire pairs. This shielding reduce crosstalk in the termination area. A series of mounting arms are provided and these mounting arms are attached, such as by soldering, to the ground circuits on the circuit board via selected contact pads. The mounting arms may be stamped and formed from the same metal blank as the ground plate. The mounting arms are spaced apart widthwise, a sufficient distance to accommodate a wire pair between pairs of mounting arms. Moreover, the extension member can assist in providing strain relief to the cable assembly when the circuit board is overmolded with an insulative material at least in the termination area. Suitable overmolding materials include plastics and/or epoxies.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
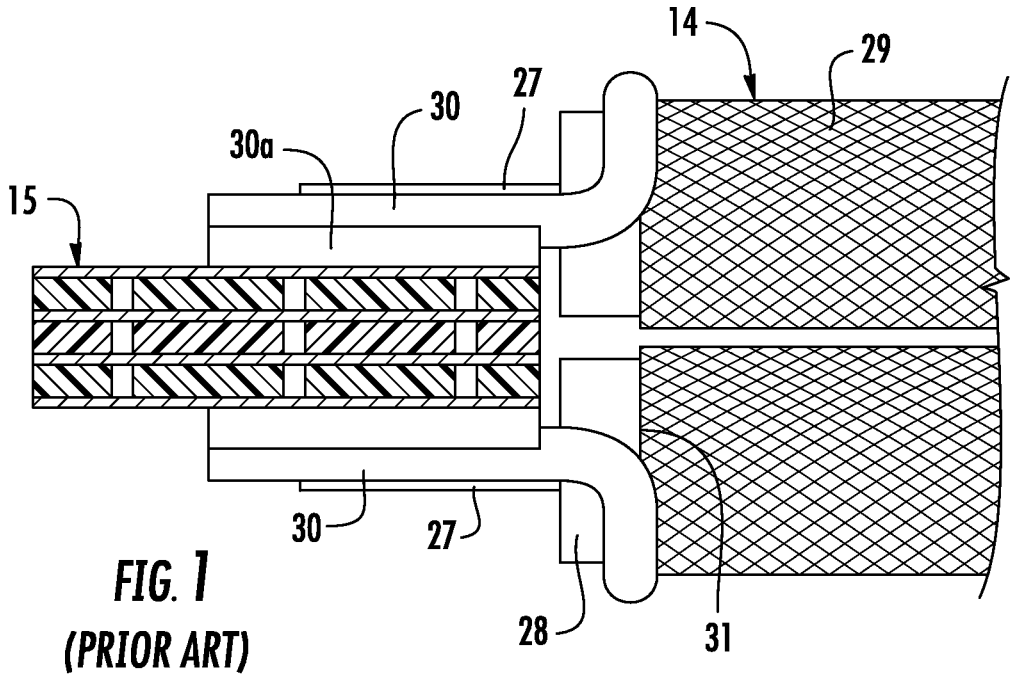
FIG. 1 (PRIOR ART)
FIG. 1 illustrates a sectional view taken through the termination area of a conventional cable-circuit board assembly.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

FIGS. 1-4 illustrate a conventional cable connector 10 (FIG. 2) that has an outer connector housing 11 with a hollow termination end 13 that receives an end of a multiple-wire cable 14, and a smaller mating end 12 and partially encloses a circuit board 15. The mating end 12 of the connector holds a mating blade, shown as the circuit board 15, shown in the form of a paddle card, in an orientation that is suitable for mating with an opposing, mating receptacle connector (not shown) which has a slot that receives the forward, mating end of the circuit board 15. In order to provide a means for ensuring engagement with the opposing connector after mating, the connector 10 is also preferably provided with an elongated latch member 17 with engagement hooks or the like disposed at its forward end. These hooks are received in openings disposed in the opposing connector. The latch member 17 is actuated by the manipulation of an actuator 18, shown as a pull tab.

Figure 2:
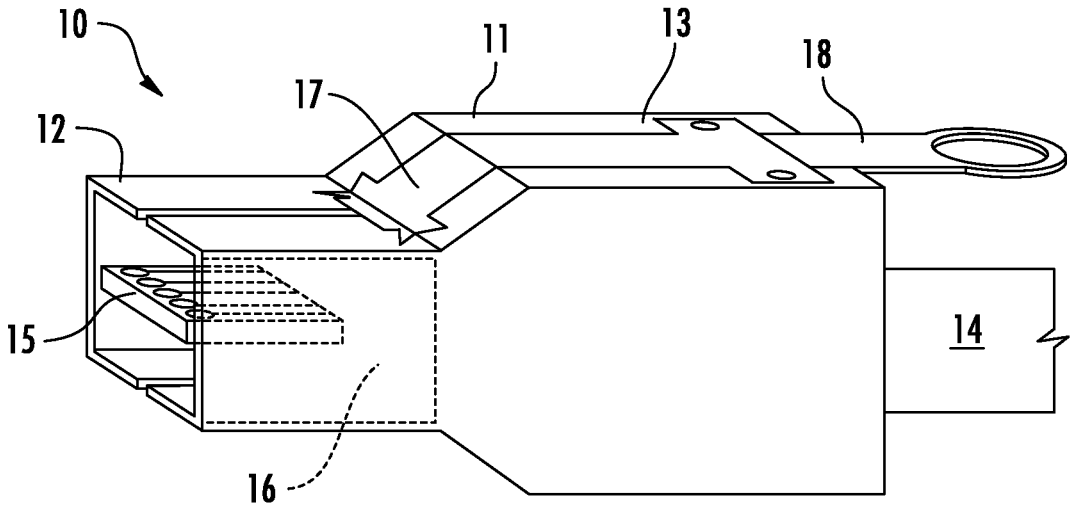
FIG. 2 is a perspective view of typical cable connector housing in which cable-circuit board assemblies of the type illustrated in FIGS. 1 and 5 are housed.
Figure 3:
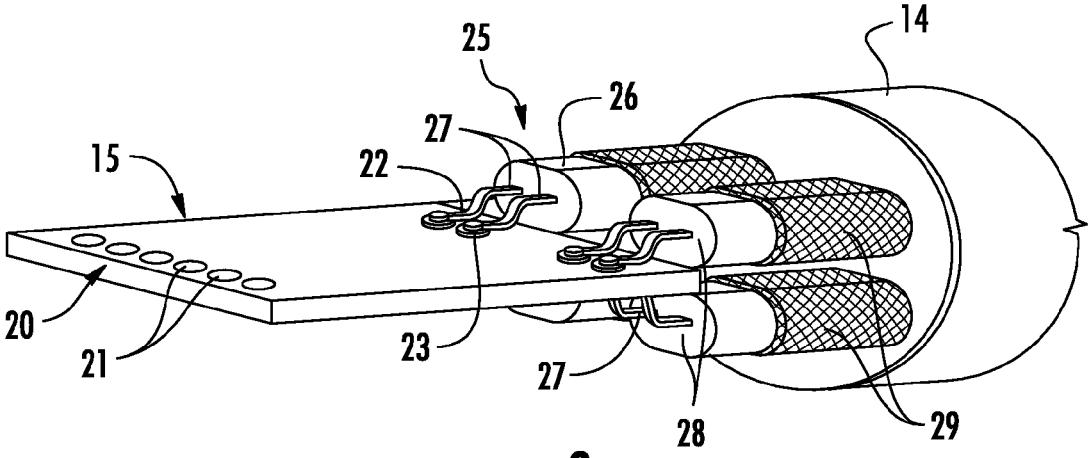
FIG. 3 (PRIOR ART)
FIG. 3 is a perspective view of the cable-circuit board assembly of FIG. 1 and which is used in combination with the Present Disclosure.

FIG. 3 is a perspective view of a conventional termination structure used in the connector of FIG. 2 and which terminate individual wires 25 of the cable 14 to circuits on the circuit board 15. As shown in FIG. 3 the cable 14 encloses a plurality of wires 24. The wires illustrated are of the twin-ax construction, meaning that they have a pair of conductors 27 running along their lengths and in a spaced apart fashion. The conductors 27 are held in place by an outer insulative and dielectric covering 26. The dielectric covering 26 is itself enclosed by an outer shield member 29. The dielectric covering 26 may enclose the pair of conductors 27, as shown best in FIGS. 3-4, or the dielectric covering 26 may be a pair of coverings, with one of the coverings enclosing one of the conductors. An outer shield member 29 is shown as extending around the dielectric covering and this shield member may take the form of a braided wire or a copper foil or the like. A drain wire 30 is commonly provided that extends for the length of the wire pair in a spiral pattern therearound and underneath the outer shield 29. The cable wires 24 are arranged in two rows, with a first set of cable wires attached to first termination contact pads and the second set of cable wires being attached to second termination contact pads of the circuit board.

Figure 4:
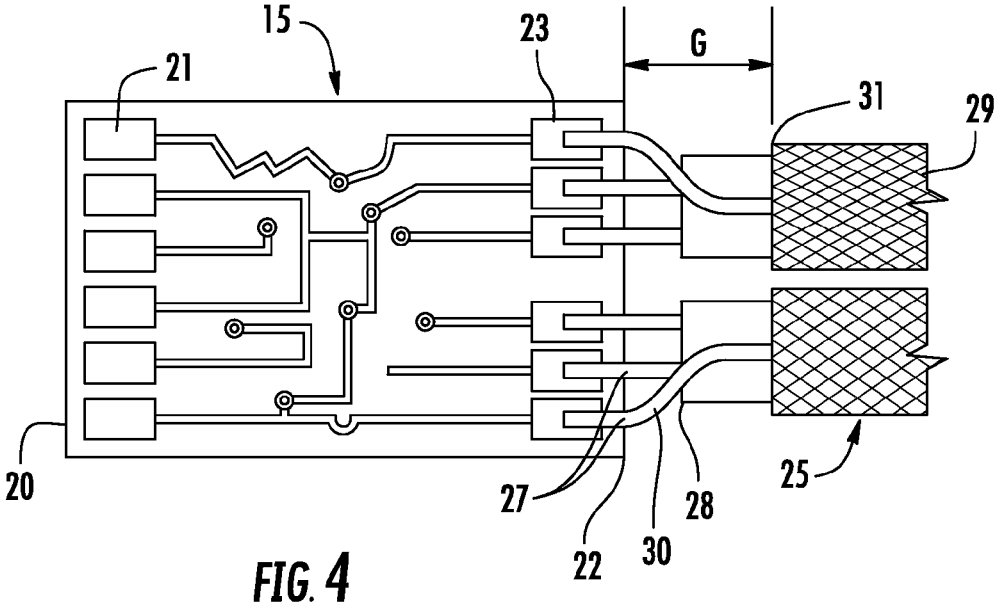
FIG. 4 (PRIOR ART)
FIG. 4 is a top plane view of the cable-circuit board assembly of FIG. 3.

Turning to FIG. 4, which is a plan view of the termination structure shown in FIG. 3, it can be seen that the circuit board 15 takes the general form of a rectangle and has a leading edge 20 and a trailing edge 22. The leading edge 20 is the forward-most edge of the circuit board 15 and is that portion of the circuit board that is inserted into the card-receiving slot of an opposing, mating connector. The circuit board 15 is typically formed with an array of conductive first contact pads 21 disposed proximate to the circuit board leading edge 20 that mate with terminals of the opposing connector. The circuit board 15 further includes a plurality of conductive second termination contact pads 23 disposed proximate the trailing edge 22 thereof. The free ends 25 of the cable wire conductors 27 are terminated to the termination contact pads 23 as by soldering.

Figure 10:
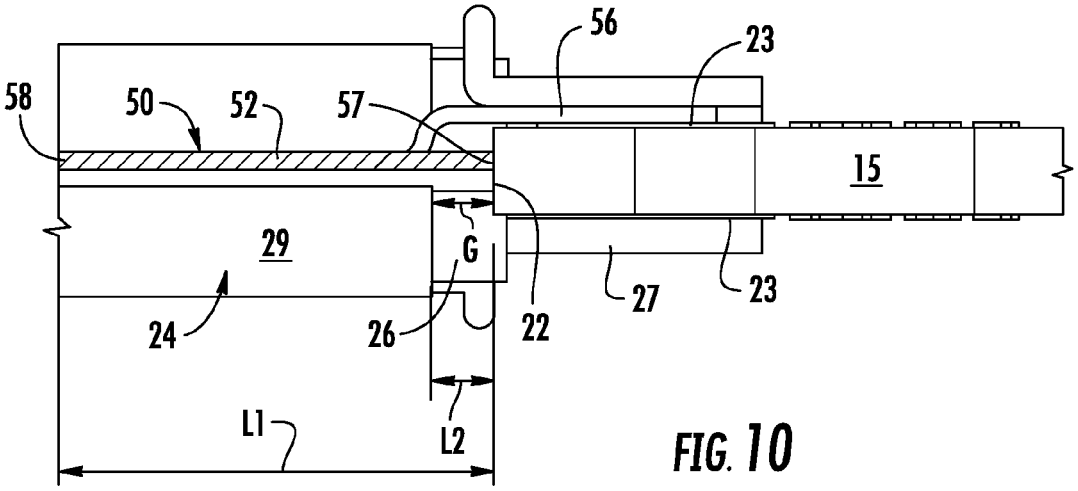
FIG. 10 is a cross-sectional view of the cable-circuit board assembly of FIG. 5, taken along Line 10-10 thereof, illustrating the relative locations of the wire pairs and ground plate extension member in the lengthwise direction.

For termination, the free ends 25 of the cable wire conductors 27 are exposed by removing a given length of their outer covering(s) 26, and their associated outer shield member(s) 29. The removal of these materials defines respective leading edges 28, 31 of the wire insulation coverings 26 and the shield members 29. Both of these leading edges are spaced apart from the free ends 25 of the cable wire conductors 27. These leading edges 28, 31, as shown best in FIG. 4, also are spaced rearwardly of the circuit board contact pads 23 and the trailing edge 22 of the circuit board 15. The distance between the circuit board trailing edge 22 and the leading edge of the outer shield member(s) 29 defines a gap "G" having a lengthwise distance of L2 through which the cable wire conductors 27 extend, partly in an insulated condition and partly in a bare, exposed condition (FIG. 10). In this area, the wire conductors 27 have no ground with which to reference. Drain wires 30 associated with each twin-ax pair may be provided and they are separately attached to the circuit board termination contact pads 23 that are connected to ground circuits or an internal ground plane layer of the circuit board 15.

In the gap area, the cable wires 24 are arranged in first and second sets of wire pairs. The first set of cable wire pairs are terminated to the termination contact pads on the top surface of the circuit board 15, the second set of cable wire pairs are attached to the termination contact pads on the bottom surface of the circuit board 15. The wire pairs are arranged in side-by-side order and further arranged in two vertically spaced apart and generally horizontal planes. These two sets of cable wires are separated from each other by a vertical spacing. In the gap, G, where the outer shielding 29 has been removed from over the signal wire conductors, no ground plane is present as any ground plane of the circuit board construction ends at or near the trailing edge of the circuit board 15. Hence, there is no shielding in this gap area between the first and second sets of wire pairs. Even though the gap distance is relatively small, typically less than one inch, crosstalk will occur between the first and second sets of wire pairs at high data transfer speeds, such as between about 6 and about 10 Gigabits per second (Gbps) and this crosstalk inhibits efficient signal transmission and may lead to discontinuities in the impedance profile of the cable assembly.

Figure 5:
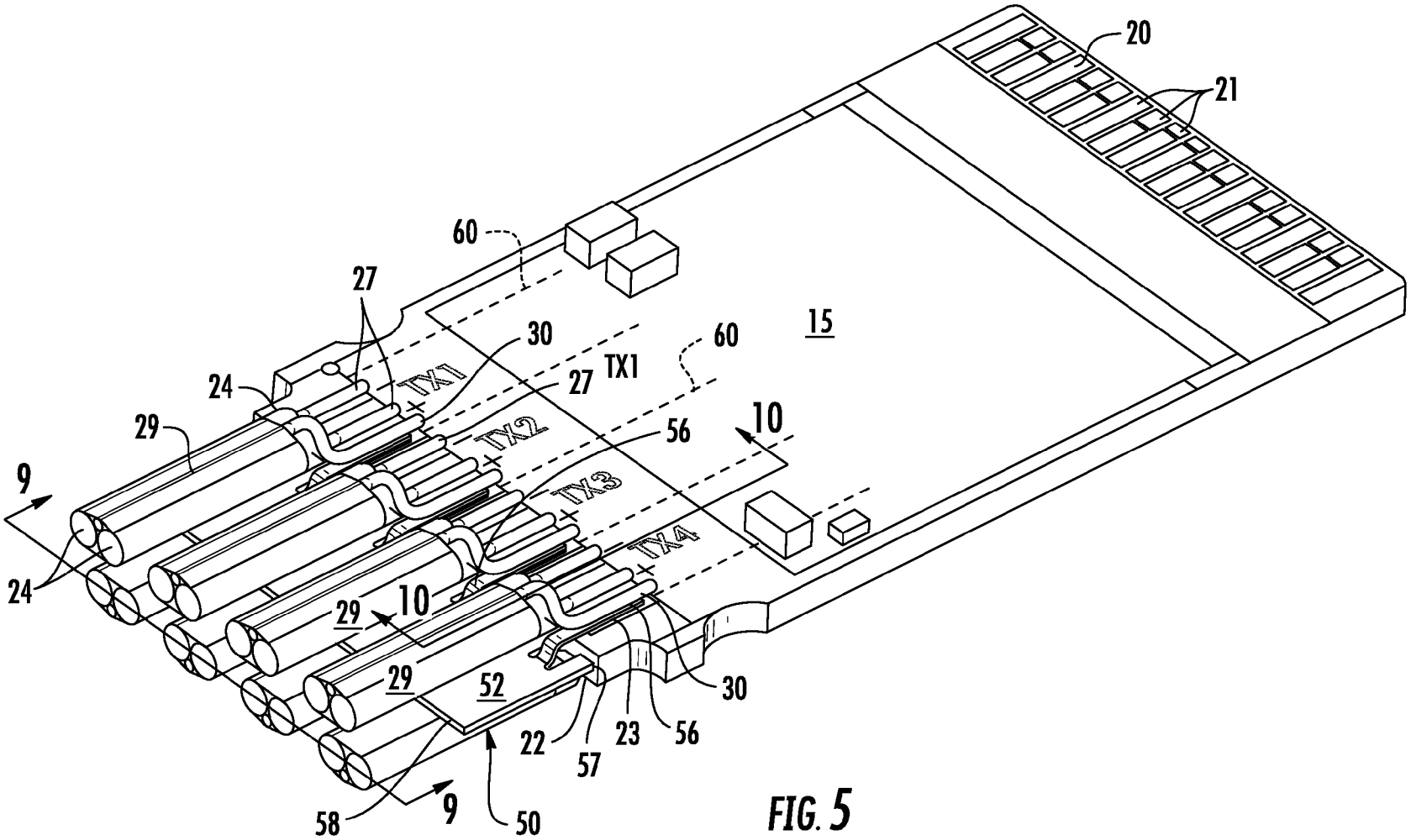
FIG. 5 is a perspective view of a cable-circuit board assembly constructed in accordance with the principles of the Present Disclosure, showing the top of the circuit board.
Figure 6:
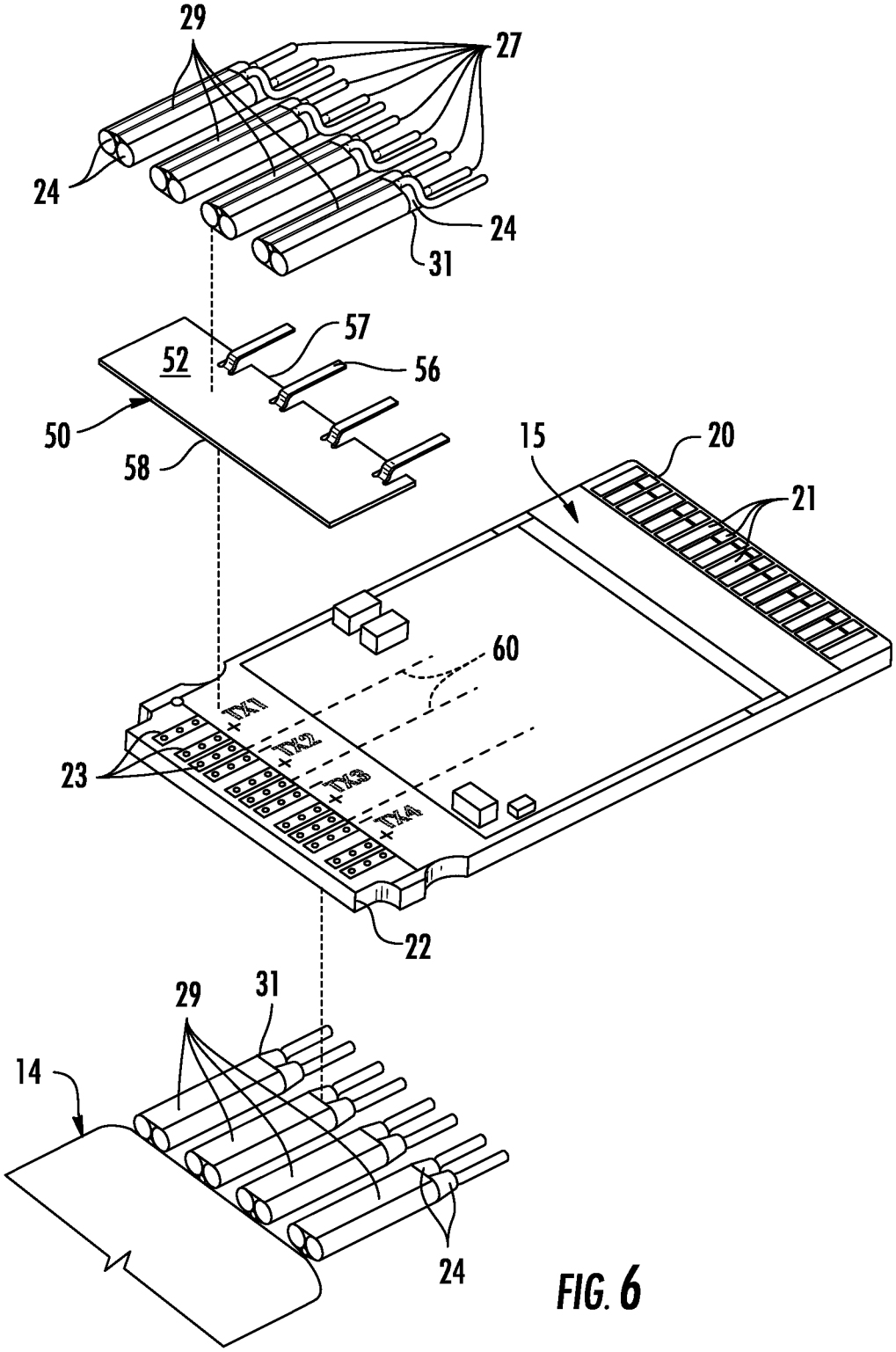
FIG. 6 is an exploded view of the cable-circuit board assembly of FIG. 5.
Figure 7:
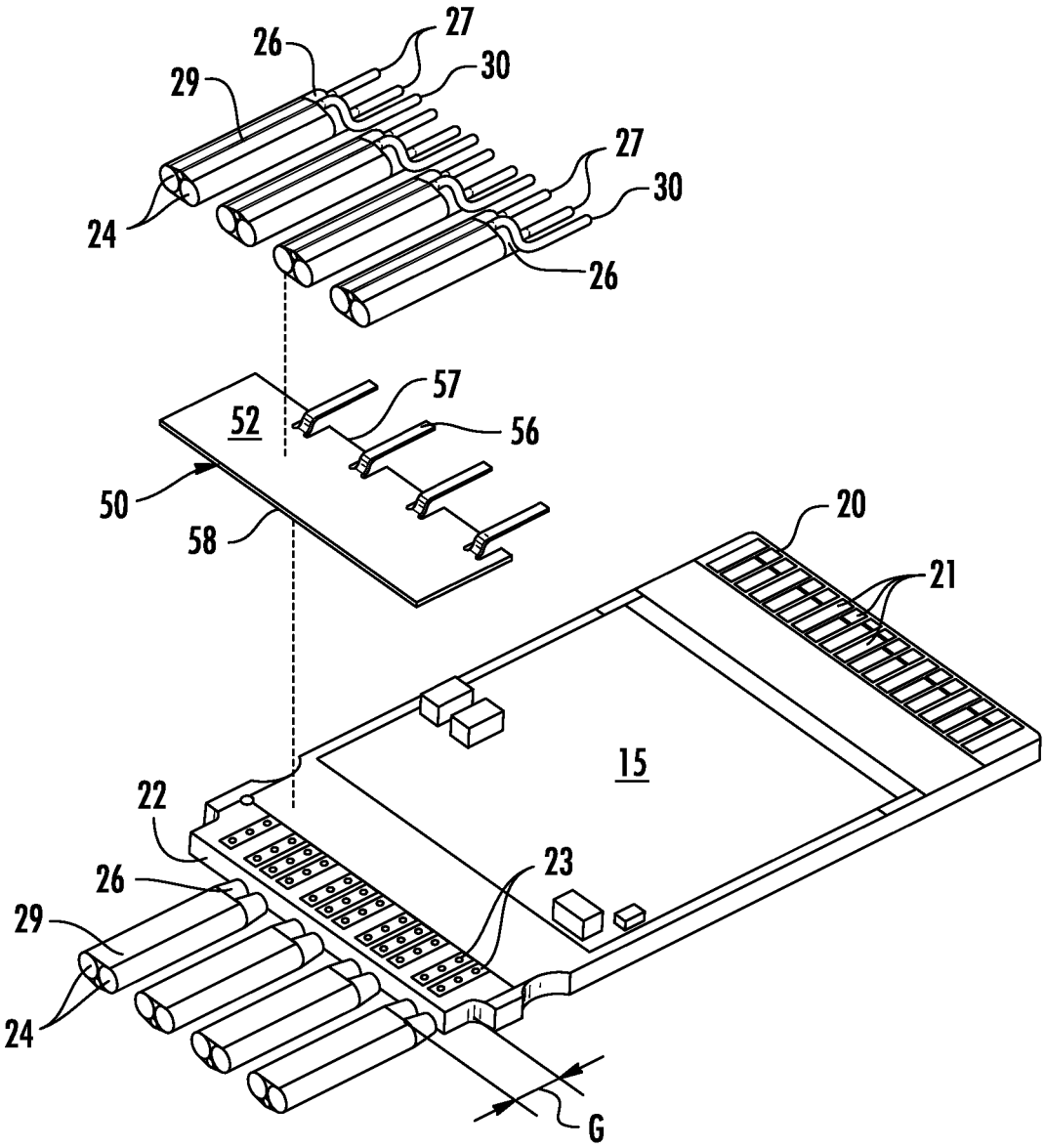
FIG. 7 is the same view as FIG. 5, but with the top set of wire pairs and ground plate extension member removed for clarity.
Figure 8:
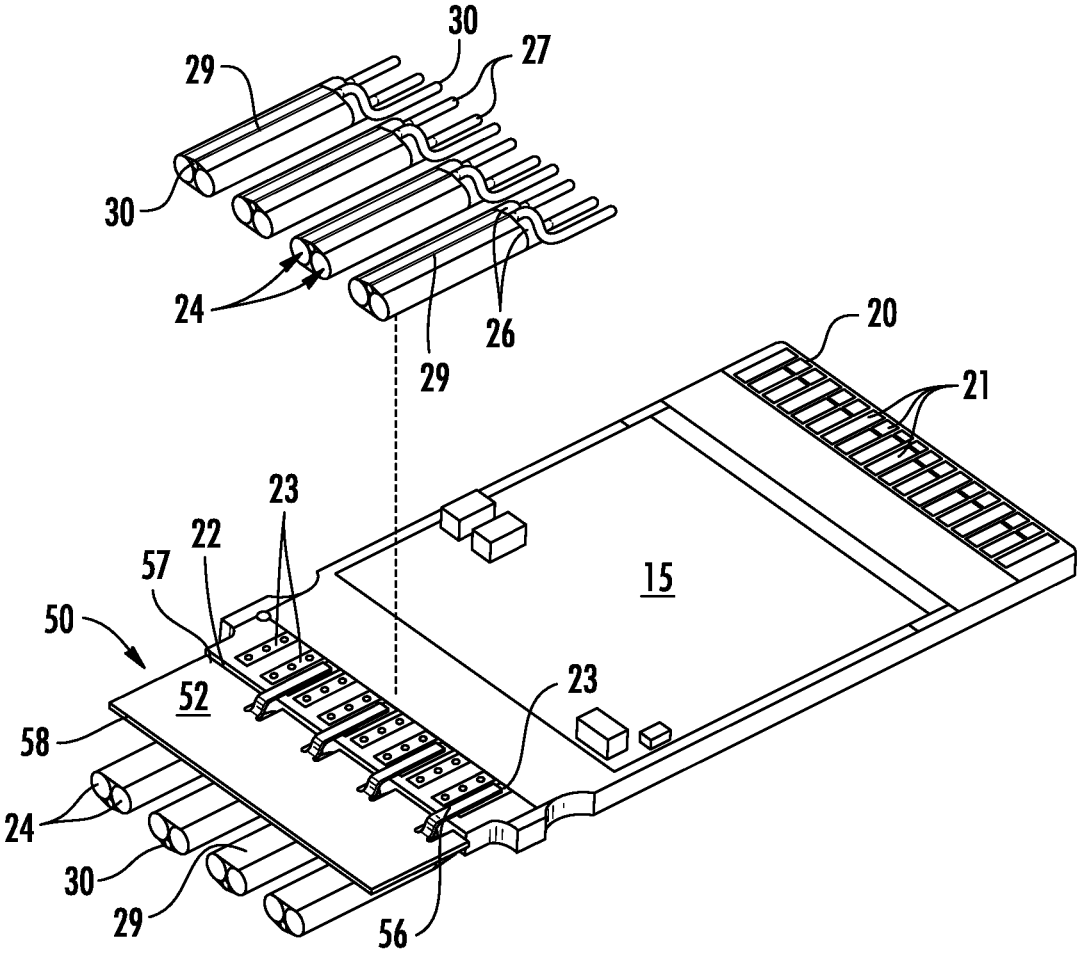
FIG. 8 is the same view as FIG. 7 but with the ground plate extension member attached to the trailing edge of the circuit board.
Figure 9:
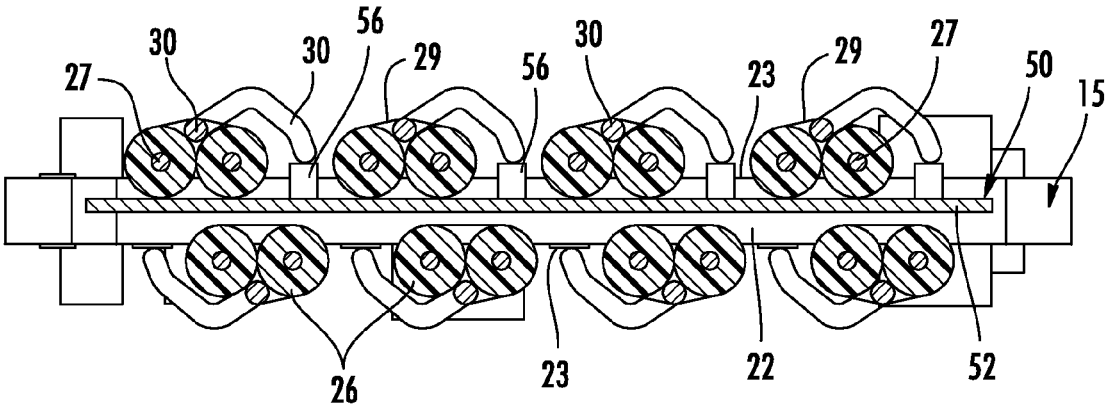
FIG. 9 is a cross-sectional view of the cable-circuit board assembly of FIG. 5, taken along Line 9-9 thereof and illustrating the relative locations of the top and bottom wire pairs and ground plate extension member.

FIGS. 5-10 illustrate our solution to this problem. The circuit board 15 of FIGS. 5-10 has eight distinct signal transmission channels that each include a pair of cable wires 24. Four of the transmission channels are located, figuratively speaking, on the top surface of the circuit board while the remaining four transmission channels are located on the bottom surface of the circuit board 15. The four transmission channels are illustrated in FIG. 6 as TX1 through TX4 and the three termination contact pads that make up the transmission channel (positive, negative and ground) are shown grouped together by the dashed lines 60.

In order to reduce crosstalk between the first (upper) and second (lower) sets of wires, we provide a ground extension member 50 in the form of an elongated ground plate 52 which has a planar base portion 54 having a front to back length of L1, and a plurality of individual mounting arms 56. The ground plate 52 is disposed exterior of the circuit board and it has a width that is preferably equal or less than the width of the circuit board 15 and it has a leading (front) edge 57 and a trailing (rear) edge 58. In order to attach the ground plate 52 to the circuit board 15, a the mounting arms 56 are preferably stamped and formed to define offset arms that are arranged along the leading edge 57 of the ground plate 52. The mounting arms 56 rise up from the plane of the ground plate 52 and extend forwardly of the ground plate leading edge 57 past the trailing edge 22 of the circuit board 15. Preferably, the mounting arms 56 have a length (from the ground plate to the tip end) that is about 20% to about 50% of the length L1 of the ground plate 52, and most preferably a length of about 30% to about 40% of L1. This relationship provides a suitable length that eliminates crosstalk in the gap, but also provides a suitable length for reliable attachment to the circuit board termination contact pads. Preferably, when assembled in a framework for holding the ground plate 52 and the circuit board 15 together, the leading edge 57 of the ground plate 52 abuts the trailing edge 22 of the circuit board 15.

Preferably, the mounting arms 56 are spaced apart widthwise of the ground plate 52 in a spacing such that each space between the mounting arms 52 accommodate not only a cable wire pair, but also roughly aligns the cable wire pair with their associated signal termination contact pads on the circuit board 15.

The ground plate 52 may be considered as an extension of the ground planes formed within the circuit board 15 and extends from the circuit board trailing edge 22 through the gap area G for a given length which ends at a location rearwardly of the leading edge 31 of the cable wires outer shield(s) 29, whether the shield 29 is cut or peeled-back upon the of the cable wire pairs. As such, the ground plate member fills the gap G as well as provides a conductive surface that the cable wire outer shields 29 of at least one of the sets of wire pairs contact when the wire pairs are attached to the circuit board 15 as illustrated in FIG. 5. To some extent, the ground plate 52 also facilitates the attachment of the wire pairs on the top surface of the circuit board 15 as it tends to position the wire conductors 27 of the wire pairs in line with the signal termination contact pads 23 of the circuit board 15. Although not necessary, the length of the ground plate 15 permits the exterior shields 29 of the wire pairs to be soldered thereto.

Such a structure reduces the crosstalk that occurs in this area, especially at high data transfer speeds of about 6 Gbs up to about 10 Gbps and above. The use of the circuit board extension portion 35 to solve this problem does so without increasing the complexity of assembly. This new development also provides the user with the ability to integrate a strain relief aspect into the termination area. This may be done by forming a body portion utilizing a suitable material such as a plastic or an epoxy that is molded over the cable wires 24, the ground plate 52, the termination contact pads 23 and a portion of the circuit board 15.

Finally, while a preferred embodiment of the Present Disclosure is shown and described, it is envisioned that those skilled in the art may devise various modifications without departing from the spirit and scope of the foregoing Description and the appended Claims.

What is claimed is:

1. A cable assembly, comprising:

a cable having an plurality of wires, the wires arranged in first and second sets, each of the wires including a conductor surrounded by an insulative covering with a respective first leading edge, wherein pairs of the wires are wrapped together in an outer shielding member, the conductor of each wire extending past the corresponding first leading edge to define a free end, wherein each of the outer shielding members has a respective second leading edge that is spaced rearwardly from the first leading edge;

a circuit board having a third leading edge and a first trailing edge and a first surface and a second surface, the first and second surfaces opposing each other, the circuit board including a plurality of termination contact pads disposed proximate the first trailing edge on the first and second surfaces, the free ends of the wires in the first set being terminated to the termination contact pads along the first surface and the free ends of the wires in the second set being terminated to the termination contact pads along the second surface;

a ground extension member attached to the circuit board and extending in a plane rearwardly of the first trailing edge, the ground extension member being interposed between the first and second sets, the ground extension member including a conductive plate having a fourth leading edge and a second trailing edge, the fourth leading edge being adjacent the first trailing edge and a trailing edge that is disposed rearwardly of at least some of the second leading edges of the outer shielding members of the wires, and a connector housing partially enclosing the circuit board and the ground extension member.

2. The cable assembly of claim 1, wherein the wires are arranged in pairs and each pair includes a drain wire associated therewith and each of the drain wires is terminated to the ground extension member proximate the termination contact pads.

3. The cable assembly of claim 1, wherein the outer shielding members include conductive braided shields and the braided shields of the wires in the first set contact the ground extension member.

4. The cable assembly of claim 1, wherein the outer shielding members include a conductive outer wrapping and pairs of the wires in the first set are wrapped in the conductive outer wrapping that contacts the ground extension member.

5. The cable assembly of claim 1, wherein the conductive plate is disposed rearwardly of the circuit board and the ground extension member includes a plurality of mounting arms that extend forwardly from the conductive plate, wherein the mounting arms are terminated to selected termination contact pads on the first surface.

6. The cable assembly of claim 5, wherein the mounting arms are spaced apart from each other widthwise by a predetermined spacing, the predetermined spacing being large enough so that one of the pairs of wires can be terminated therebetween.

7. The cable assembly of claim 5, wherein the mounting arms have an offset configuration such that the mounting arms extend upwardly and forwardly of the fourth leading edge.

8. The cable assembly of claim 1, wherein the fourth leading edge abuts the first trailing edge.

9. The cable assembly of claim 1, wherein the conductive plate is positioned with respect to the circuit board such that the conductors of the first set lie in contact with the termination contact pads on the first surface.

10. The cable assembly of claim 1, wherein a portion of the circuit board and the ground extension member are overmolded with an insulative material to fix the cable wires and ground extension member in place with respect to the circuit board.

11. The cable assembly of claim 5, wherein the ground extension member extends rearwardly from has a length of L1 and the mounting arms have a length of about 0.2 to about 0.5 L1.

12. A circuit board assembly for use in a high speed cable connector, the assembly comprising:

a cable including at least a first pair and a second pair of signal wires, each signal wire including an inner conductor surrounded by a dielectric covering, the first and second pairs each being enclosed within a respective outer shield that extend over the dielectric coverings, each of the inner conductors having a free end that extend past associated ends of the corresponding dielectric covering and the outer shield;

a circuit board having a leading edge and a trailing edge, the circuit board including a first surface and a second surface that oppose each other, the circuit board including a first set and a second set of termination contacts respectively disposed on the first and second surfaces, the first and second pairs of signal wires being respectively terminated to the first and second sets of termination contacts in a manner that defines a vertical gap that extends horizontally between the first and second pairs of signal wires; and a conductive member disposed in the vertical gap, the conductive member defining an extended ground plane disposed exterior of the circuit board and extending rearwardly from proximate the trailing edge for a first distance L1, and the outer shields having leading edges disposed on the wire dielectric coverings a second distance L2 from the trailing edge, the first distance L1 being greater than the second distance L2, the ground plane being interposed in the vertical gap.

13. The circuit board assembly of claim 12, wherein each pair of signal conductors is surrounded by a single dielectric covering.

14. The circuit board assembly of claim 12, wherein the conductive member includes a plurality of mounting arms extending from the ground plane into contact with selected ones of the termination contacts, the mounting arms including contact surfaces disposed in a plane that is different from the ground plane.

15. The circuit board assembly of claim 14, wherein the mounting arms are spaced apart from each other widthwise of the grounding plate and terminated to the first termination contacts on the first surface.

16. The circuit board assembly of claim 12, wherein the ground plane and the free ends are overmolded with an insulative material to fix the signal wires in place with respect to the circuit board.

17. The circuit board assembly of claim 14, wherein the mounting arms have a length of about 20% to about 50% of the first distance.

18. A cable assembly, comprising:

a cable with a plurality of wires arranged in a first set and a second set, each of the wires including an insulative covering and an outer shield enclosing the insulative covering, the plurality of wires further including a conductor with a termination free end, wherein the outer shields each include a first leading ledge spaced rearwardly from the end of the insulative covering;

a circuit board having a second leading edge and a first trailing edge, the circuit board including a first surface and a second surface, the circuit board including a plurality of termination contact pads disposed proximate the first trailing edge, the termination free ends being terminated to the termination contact pads;

a ground plate attached to and extending rearwardly of the first trailing edge, the ground plate being interposed between the first and second sets, the ground plate having a third leading edge and a second trailing edge, wherein the third leading edge is proximate the first trailing edge and the second trailing edge is disposed rearwardly of the first leading edges of at least some of the wires, and a connector housing partially enclosing the circuit board and the ground plate.

19. The cable assembly of claim 18, wherein the ground plate is disposed rearward of the circuit board and a plurality of mounting arms extending forwardly from the ground plate and are terminated to selected termination contact pads of the circuit board, the mounting arms having an offset configuration such that the mounting arms and the ground plate are aligned with two different planes.

20. The cable assembly of claim 18, wherein the cable wires are arranged in pairs and each pair includes a drain wire associated therewith and the drain wires are respectively terminated to the ground plate mounting arms.

* * * * *